US011708638B1

(12) United States Patent
Taitel et al.

(10) Patent No.: US 11,708,638 B1
(45) Date of Patent: Jul. 25, 2023

(54) PUSH FIT ANODE PLUG AND HOLDER FOR SACRIFICIAL ANODES

(71) Applicant: Howard Taitel, Shrewsbury, MA (US)

(72) Inventors: Howard Taitel, Shrewsbury, MA (US); Pragun Goyal, Brighton, MA (US)

( * ) Notice: Subject to any disclaimer, the term of this patent is extended or adjusted under 35 U.S.C. 154(b) by 284 days.

(21) Appl. No.: 16/910,249

(22) Filed: Jun. 24, 2020

(51) Int. Cl.
*C23F 13/18* (2006.01)
*C23F 13/20* (2006.01)
*C23F 13/10* (2006.01)

(52) U.S. Cl.
CPC ..... *C23F 13/18* (2013.01); *C23F 13/10* (2013.01); *C23F 13/20* (2013.01)

(58) Field of Classification Search
CPC ..... C23F 13/18; C23F 13/10; C23F 13/08; C23F 13/06
See application file for complete search history.

(56) References Cited

U.S. PATENT DOCUMENTS 2,947,680 A * 8/1960 Preiser ..... C23F 13/18 403/368
3,234,824 A * 2/1966 Lyvers ..... B25B 31/00 29/283.5
3,483,789 A * 12/1969 Wurzel ..... F16B 21/20 411/517
4,773,977 A * 9/1988 Houle et al. ..... F24H 9/2007 204/196.17
4,775,273 A * 10/1988 Bauer ..... F16B 2/205 411/521
8,801,048 B2* 8/2014 Morris et al. ..... F16L 37/091 285/345
2013/0318781 A1* 12/2013 Mariano et al. ..... F01D 25/285 29/700
2014/0069803 A1* 3/2014 McMullen ..... C23F 13/22 204/196.17

FOREIGN PATENT DOCUMENTS

DE 29721278 U1* 5/1998 .....C23F 13/10
RU 2601031 C1* 10/2016 .....C23F 13/00

* cited by examiner

*Primary Examiner* — Alexander W Keeling
*Assistant Examiner* — Mofoluwaso S Jebutu
(74) *Attorney, Agent, or Firm* — Patent GC; Alexander Franco

(57) ABSTRACT

A system consisting of a pencil-type sacrificial anode rod and a companion plug for use in, e.g., marine engines, generators, and other machinery or fluid-containing components requiring the presence of sacrificial anodes to prevent galvanic and electrolytic corrosion. The anode rod is securely held in the plug via a push-to-connect mechanism that allows the anode rod to rotate when acted on by a torsional force. This mechanism allows for extraction of the plug through pure tensile forces on the anode rod, thus preventing the breaking of stuck anode rods through torsional forces or stuck anode rods being left behind in engine components due to unthreading of the anode rod from the plug. Electrical continuity between the anode rod and plug is continuously maintained via metal-to-metal contact.

18 Claims, 7 Drawing Sheets

DETAIL C
Retention Apparatus 265

DETAIL D

DETAIL B

PUSH FIT ANODE PLUG AND HOLDER FOR SACRIFICIAL ANODES

TECHNICAL FIELD

The present invention generally relates to sacrificial anodes for marine engine components and other machinery using pencil-type anodes, e.g., for corrosion protection.

BACKGROUND OF THE INVENTION

Marine engines are generally cooled with a combination of antifreeze and seawater. The antifreeze coolant runs throughout the engine components similar to that of an automobile. As the coolant circulates, it absorbs heat from the engine. As this process continues, the coolant itself increases in temperature and a mechanism must be employed to remove heat from the coolant and disperse it into the environment. In an automobile, the function of removing heat from the coolant is performed by the radiator. The radiator routes warm coolant through a series of small tubes and air flow over the surface serves to carry excess heat away from the coolant and into the atmosphere. This method of cooling does not directly translate to the marine environment as engines are located in bilge areas or sealed in waterproof cowlings. Accordingly, there is generally not enough airflow for cooling. Moreover, unlike automobiles, boats have an infinite amount of cooling water available to them at all times and have additional cooling requirements due to the characteristics of marine exhaust systems. Therefore, on boats, raw seawater heat exchangers take the place of the radiator, particularly concerning saltwater or freshwater taken from outside the boat. Warm engine coolant is circulated through a series of small tubes similar to radiators, but these tubes are encapsulated in a shell through which raw seawater flows. The cool seawater carries heat away from the coolant and out to the sea. This system is not only used for coolant, but also to cool various liquids and gases in the engine, such as intercooler/aftercooler, oil cooler, transmission oil cooler, etc.

One difficulty in using seawater for cooling is corrosion. Salt water acts as an electrolyte and, in the presence of the dissimilar engine metals, a galvanic circuit is created similar to the chemistry that occurring in a battery. The less noble metals give up electrons, leading to corrosion. In order to prevent expensive engine components from corroding, pencil-type sacrificial anodes are used in the engine coolers. These anodes are typically made of zinc, but other materials such as aluminum and magnesium are often used. The present application, consistent with common marine terminology, uses the term "zinc" to encompass anodes of any material. Zincs are less noble than the metals used in the engine and, as long as electrical contact between the cooler and zinc is maintained, will lose electrons first, thereby protecting the various engine coolers. As these zincs are sacrificial, they need to be replaced periodically with the replacement interval governed by a variety of factors.

Pencil-type zincs, which come in a plurality of sizes, consist of a zinc rod, threaded on one end, and a brass plug. Referring now to FIG. 1, the plug 100 contains both a female threaded inner cavity 105, which accepts and retains the zinc rod (also known as "pencils") 110, and outer male threads 115 which fasten the anode-plug assembly 120 to the cooler 125. The outer threads are NPT, which allows for a leak-proof seal to the engine component without the use of thread sealants. The ability of the plug to achieve a seal between its outer threads and the cooler without the use of sealants, e.g., Teflon tape, pipe dope, etc., is imperative, as good electrical contact must be maintained between the cooler and the plug -and by extension the submerged zinc rod in order for the zinc to perform its sacrificial duties. The use of any sealant is uniformly discouraged by zinc suppliers, engine suppliers, and mechanics, as it can interfere with the electrical connection between the outer threads and the cooler.

While the current generation of zincs and plugs provide corrosion protection, various issues arise in the maintenance of the zinc rod-plug combination. In general, these issues are related to the removal of the pencils from the cooler cavity at its service interval. In the ideal scenario, the plug is unscrewed from the cooler and what remains of the zinc rod comes along with it, such that replacing a zinc rod could be done in a matter of minutes. However, the zinc rod do not waste down perfectly; rather, their surfaces become scaled, pitted, and swollen. As a result, the zinc pencil often gets stuck in the hole of the cooler, which, in reference to FIG. 1, causes the internal plug threads 105 to unscrew from the threads 135 of zinc rod 110 as it is removed from the cooler via outer plug threads 115. Consequently, the zinc rod is left behind in the cooler instead of the intended result of the anode-plug assembly 120 coming out as a single unit.

Another scenario that often occurs is the bottom portion of the zinc rod gets stuck or fused to the cooler and separately the threaded top of the zinc rod 135 gets fused to the plugs inner threads 105 via corrosion. Essentially, the corrosion at threads 105 effectively and unintentionally transforms plug 100 and rod 110 into one body. In this scenario, when unscrewing the plug from the cooler via outer plug threads 115, the softened zinc breaks at the vulnerable shoulder 130. This is the area where the zinc rod transitions from full width to the smaller diameter threaded region, leaving the threaded portion of the zinc stuck in the plug cavity and the remaining wider portion of the zinc rod stuck in the cooler opening. The breakage is due to torsional strain at shoulder 130 when the plug 100 is forced to rotate by means of a wrench for removal, but the stuck rod is unable to do the same. Remnants of the zinc rod left behind make reuse of the plug difficult. This problem is currently solved in a variety of ways, such as by discarding the plug, drilling out the remnant, or soaking the plug in muriatic acid to dissolve the zinc remnants.

Removal of these zincs left behind in the cooler is a frustrating, time-consuming, and expensive task. It is often possible to screw the plug back into the hole in the cooler just enough to grab onto the threads of the stuck rod and then wiggle out the stuck rod. However, the rod may free up and fall into the cooler before it can be extracted. Another approach is to try to grab the zinc rod with a pair of needle-nose pliers and work it out; however, similarly, the stuck zinc rod can be dislodged and fall into the cooler. Care must also be taken not to damage the threads on the cooler. A shop vacuum is sometimes able to suck out the stuck zinc from the hole. These removal operations must be done within the restricted confines of the engine room, which generally involve various contortions and often necessitating that the work is done blindly. When the zinc is unable to be extracted through the plug hole, the endcaps of the cooler can be removed, assuming the cooler has endcaps and that these endcaps are accessible without having to remove any other mechanical components. This permits removal of the zinc rod through the much larger end openings of the cooler. However, with this approach, there is the danger of stripping a bolt when removing or replacing the endcap, difficulties in replacing the gasket, and the like.

Furthermore, a degree of guesswork is involved in simply tightening replacement zinc rods into the plug cavity upon assembly, with maximum torque specifications not being defined and, even if so, unlikely to be used in practice. If too tight, the plug may break at the neck where threaded area meets the wider diameter of plug, and if too loose, the plug is at risk of loosening.

Accordingly, there is a need in the art for an improved pencil-type anode rod assembly that mitigates the problems related to removal.

SUMMARY OF THE INVENTION

The present invention is directed to a push fit retention mechanism for sacrificial anodes. It provides a replacement for traditional threaded plug cavities, thereby mitigating those difficulties encountered during anode maintenance, replacement, and installation.

According to an aspect of the present invention, guesswork regarding proper pencil torque for secure retention in the plug without overtightening and breaking the anode is eliminated. Assembly of the rod-plug is achieved simply by pushing the rod into the plug.

According to another aspect of the present invention, the anode is allowed to rotate while being securely retained by the plug. This degree of rotational freedom allows a straight linear pull to be imparted on the anode by the act of unscrewing the outer plug threads from the mechanical component, e.g., cooler. The plug becomes an implicit anode extractor/puller, mitigating the problems of zinc rods unthreading from the plug during removal and from zinc rods breaking due to torsion at the vulnerable shoulder area when they become stuck.

According to another aspect of the present invention, the retention mechanism may afford a release mechanism such that plugs can be easily and reliably reused. This overcomes the current, common instance of plugs not being able to be reused due to broken anode rod threads being stuck in the inner cavity.

According to another aspect of the present invention, the anode-plug retention mechanism provides continuous and reliable electrical connection between the zinc rod and the plug and, by extension, the mechanical component in which the assembly resides. This is achieved while still allowing the anode rod to rotate relative to the plug.

According to another aspect of the present invention, the plug provides a seal between the external plug threads and the mechanical component in which the assembly resides via the use of tapered, self-sealing threads (NPT). No thread sealants are required or allowed.

In general, in one aspect, the invention features a system including a sacrificial anode rod and a companion plug, where the sacrificial anode rod is configured to be secured within the companion plug via a retention apparatus configured to permit the sacrificial anode rod to rotate relative to the companion plug while simultaneously remaining secured within the companion plug, and continuously maintain electrical continuity between the sacrificial anode rod and the companion plug.

Implementations of the invention may include one or more of the following features. A plug cavity of the companion plug may be straight, tapered, or have a profile corresponding to a profile of a shank of the sacrificial anode rod, and house either one or more retention points and retention apparatuses to secure the sacrificial anode rod to the companion plug. A shank of the sacrificial anode rod may be straight, tapered, or have a profile corresponding to a profile of a plug cavity of the companion plug. The retention apparatus may include non-integral components and/or integral components, and the non-integral components may include one or more retaining rings, while the integral components may include one or more retaining rings formed as part of a cavity wall of the companion plug. One or more self-locking retention rings may be installed within one or more grooves or upon one or more shelves in the plug cavity of the companion plug for implementing the retention apparatus. One or more spiral rings, spring rings, and/or springs may be installed within the one or more grooves or upon the one or more shelves in the plug cavity of the companion plug for assisting in implementing the retention apparatus.

One or more internal and/or external o-rings may be provided for sealing and protecting the retention apparatus from raw water to prevent corrosion, for serving as a cushioning and stabilizing bearing surface that prevents the sacrificial anode rod from chattering against a plug wall of the companion plug and prevents fatigue at contact points in the retention apparatus, and/or for serving as a barrier between a shoulder of the sacrificial anode rod and an opening, shoulder-facing surface of the companion plug to prevent fusing together as a result of corrosion. One or more air gaps may be provided for serving as a barrier between a shoulder of the sacrificial anode rod and an opening, shoulder-facing surface of the companion plug to prevent fusing together as a result of corrosion. A release mechanism may be provided to disengage the retention apparatus and permit removal of the sacrificial anode rod from the plug cavity, and the release mechanism may include a tapered sleeve.

In general, in another aspect, the invention features a system including a sacrificial anode rod and a companion plug, where the sacrificial anode rod is configured to be secured within the companion plug via a retention apparatus configured to permit the sacrificial anode rod to rotate relative to the companion plug while simultaneously remaining secured within the companion plug, and continuously maintain electrical continuity between the sacrificial anode rod and the companion plug, and where a cavity wall of the companion plug includes one or more retaining rings formed therein.

In general, in another aspect, the invention features a system consisting of a pencil-shaped element and a receiving plug, where the pencil-shaped element is configured to be secured within the receiving plug via a retention apparatus configured to permit the pencil-shaped element to rotate relative to the receiving plug while simultaneously remaining secured within the receiving plug, and continuously maintain electrical continuity between the pencil-shaped element and the receiving plug.

Implementations of the invention may include one or more of the following features. A cavity wall of the receiving plug may include one or more retaining rings formed therein.

DETAILED DESCRIPTION OF THE INVENTION

Figure 1A:
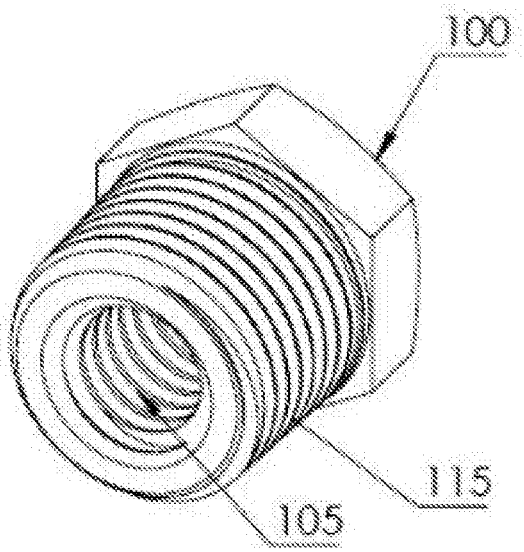
FIG. 1A PRIOR ART
FIGS. 1A-1D illustrate an overview of the basic features of zinc rod-plug assemblies currently known in the art.
Figure 1B:
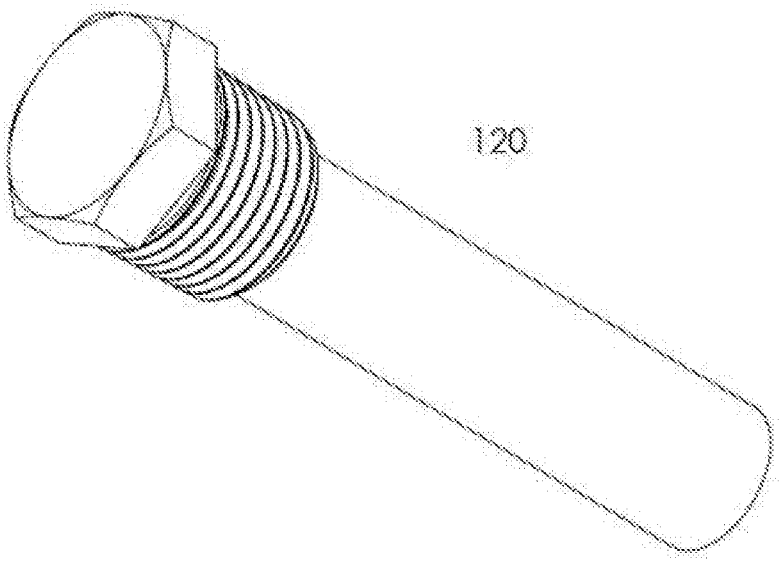
FIG. 1B PRIOR ART
Figure 1C:
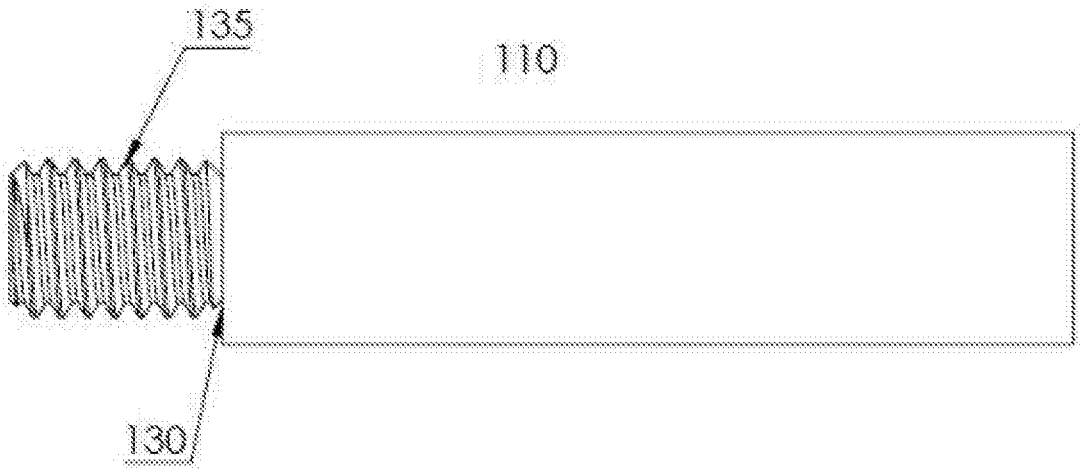
FIG. 1C PRIOR ART
Figure 1D:
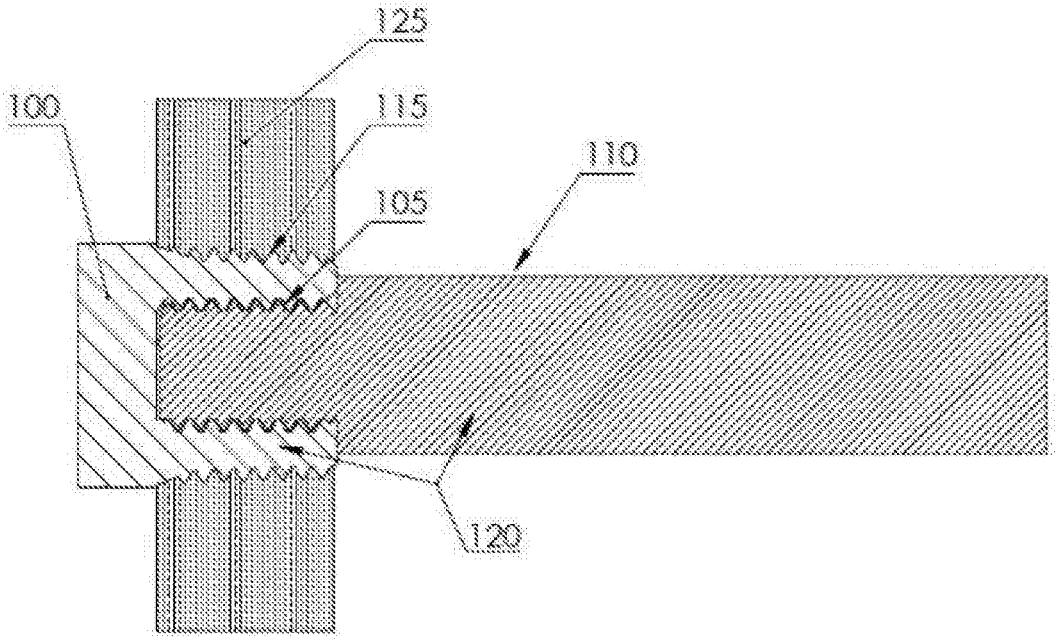
FIG. 1D PRIOR ART
Figure 2A:
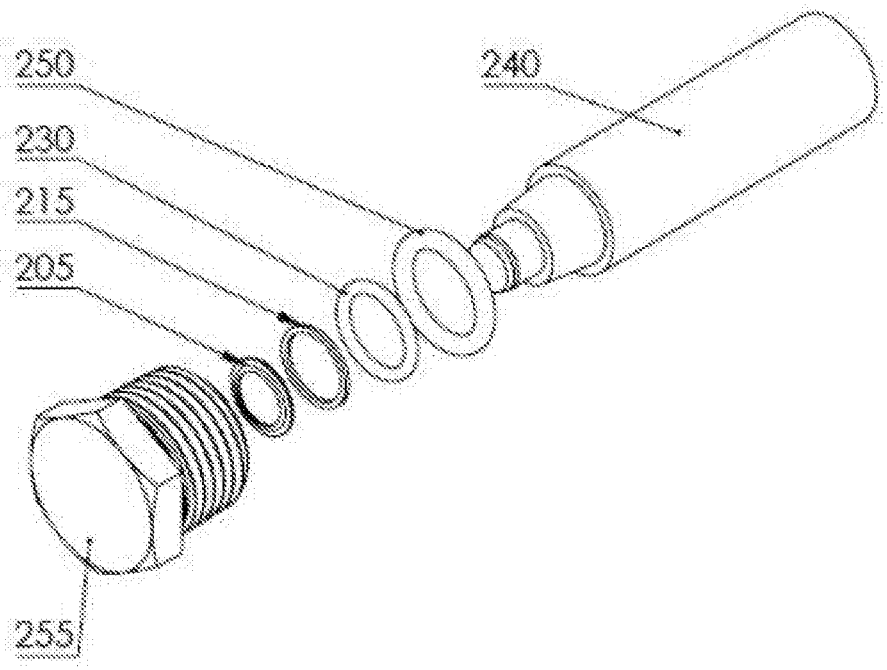
FIGS. 2A-2F illustrate aspects of the zinc rod-plug assembly according to one embodiment of the present invention.
Figure 2B:
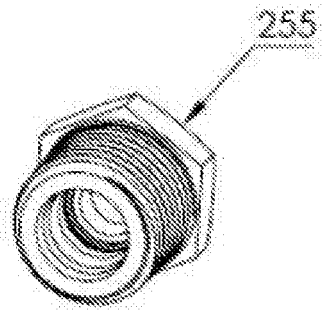
Figure 2C:
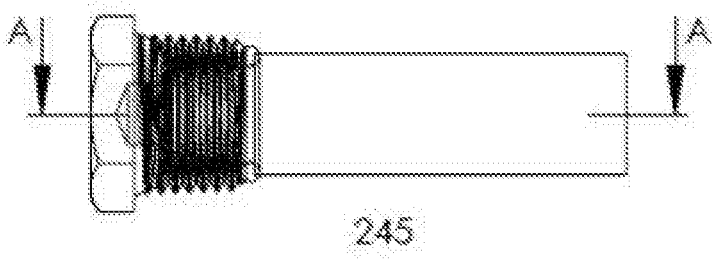
Figure 2D:
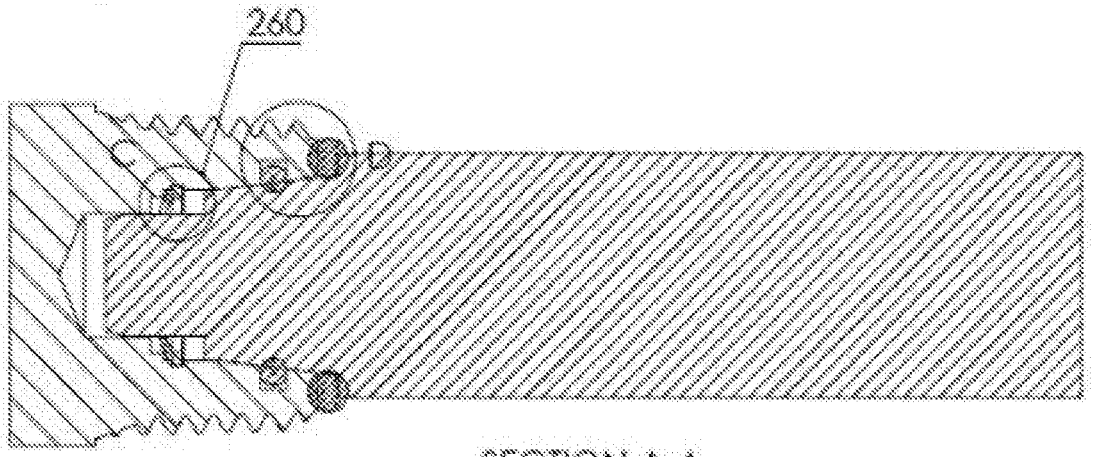
Figure 2E:
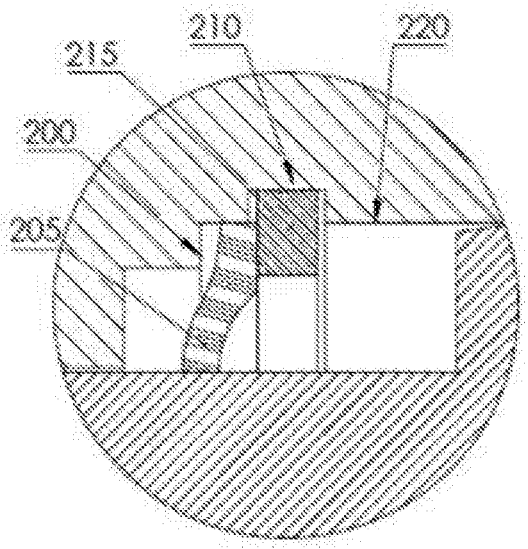
Figure 2F:
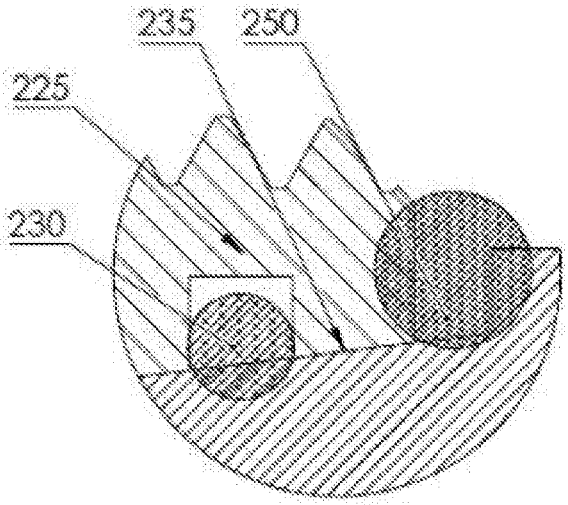

The invention is comprised of a plug and a sacrificial rod, generically referred to as "zinc" but not limited to any particular material. In the embodiment of FIG. 2, the plug cavity has a shelf 200 which supports a self-locking push ring 205. Self-locking push rings are characterized by an ability to allow a shaft to be pushed through in one direction for installation while preventing the shaft from being pulled back out, and an ability to allow the retained shaft to rotate relative to the ring. Immediately above the shelf, a groove 210 houses a spiral retaining ring 215 which retains the self-locking ring in its position on the shelf, i.e., prevents it from being pulled out of the plug cavity. The spiral ring both allows for insertion through the smaller diameter cavity 220 to the larger diameter groove 210 and serves as an ad-hoc spring helping both to maintain electrical contact and decrease play of the rod in the cavity. The self-locking push ring, groove, and spiral retaining ring combination will be referred to as the retention apparatus 265 and the location of the retention apparatus will be referred to as the retention point 260. An additional groove 225 in the plug cavity, near the plug opening, houses an o-ring 230. This o-ring serves several purposes, including stabilizing and cushioning the zinc rod, which is subject to extreme vibration and chatter due to the running engine on which it resides, and sealing the retention apparatus from seawater.

With the present embodiment using only one retention apparatus 265 located at a single retention point 260, the second point of contact provided by the o-ring prevents the rod from pivoting back and forth about the retention point, resulting from play/tolerance in the fit, and chattering against the cavity wall as the engine vibrates. To further improve fit, the plug cavity has a tapered structure 235. The spring action from the spiral retaining ring pushing against the upper wall of the retention groove 210, i.e., the face closest to the plug opening, pushes the self-locking ring holding the rod, and subsequently the rod itself, towards the bottom of the plug. This force effectively seats the rod taper against the plug taper, eliminating play and increasing metal-to-metal contact for electrical continuity. Continuity is further ensured by electrical contact at the retention point. Electrical continuity between the rod, the plug, and the component in which the assembly resides is essential to the working of sacrificial anodes. Zinc rod 240 is correspondingly tapered to match the taper of the plug cavity 235 and has a smooth shank, which is contrary to the threaded shank of pencil zincs known in the art, that is inserted into the plug cavity and pressed through the self-locking ring 205 at the retention point 260 to form the assembly 245. A gap is left between the shoulder of the zinc rod and the opening of the plug cavity to accommodate an additional o-ring 250, which improves fit, further seals the cavity, and prevents corrosion at this interface from fusing the rod and plug together. This gap is further illustrated in FIG. 4, reference character 405.

The benefit of the present invention, which is a departure from the current art of threaded connections in plug cavities, is the achievement of a retention apparatus that securely retains the sacrificial pencil rod, maintains electrical continuity between the plug and the rod, and provides for reliable removal of the plug and remnant portion of the rod from the cooler for replacement. Reliable removal refers to attributes of the present invention in which the rod is prevented from being left behind in the engine cooler due to either unthreading of the plug-rod connection when removing the plug from the cooler or breaking due to torsional strain. The present embodiment achieves this improved behavior by inventing and employing a retention apparatus that allows the rod to rotate freely while being securely held in the plug. This degree of rotational freedom results in a purely linear pull being applied along the length of the rod by the act of unscrewing the outer threads of the plug from the engine cooler. The purely tensile linear force allows stuck plugs to reliably be extracted from the engine component and eliminates torsional forces that can break the vulnerable shoulder areas of the sacrificial rods. In this way, the plug serves as both a holder and a puller for stuck rods that have become adhered to the cooler walls or that have become scaled and are now unable to fit cleanly through the cooler opening.

Figure 3A:
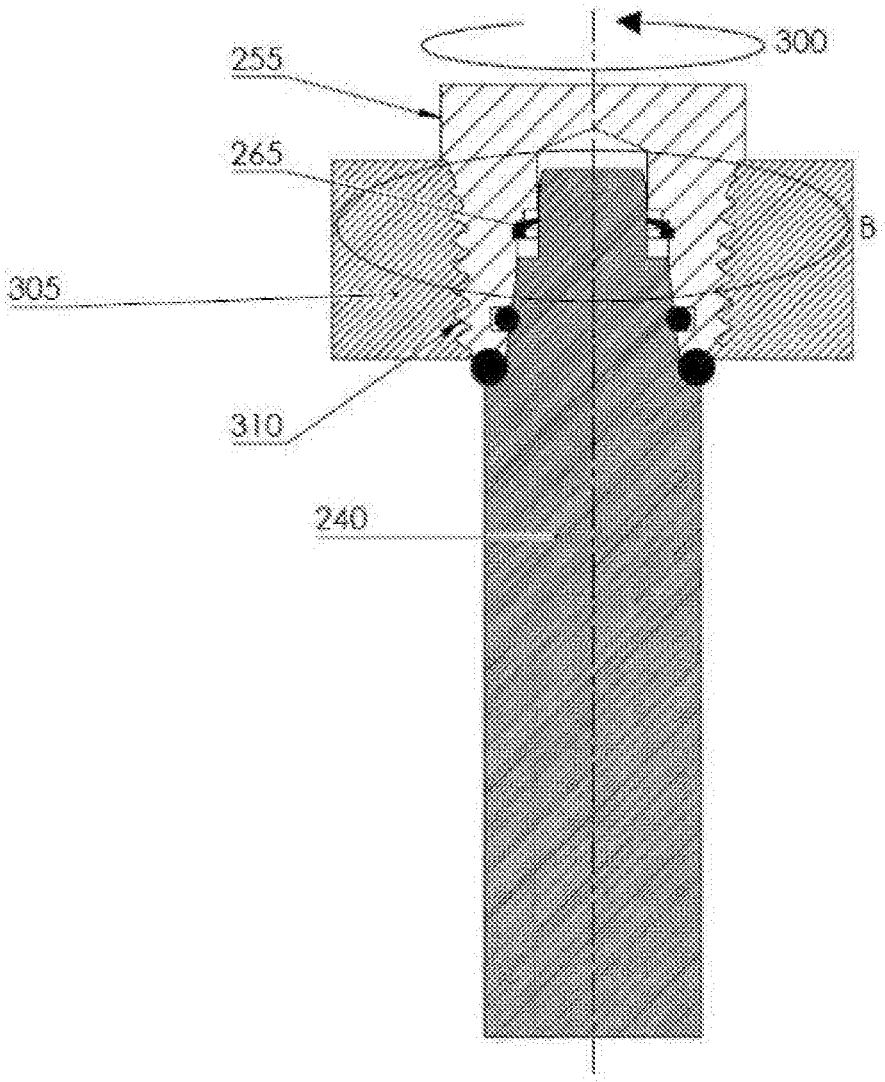
FIGS. 3A-3B illustrate relevant forces and utility of a zinc rod-plug assembly of the present invention in mitigating problems associated with those zinc rod-plug assemblies currently known in the art.
Figure 3B:
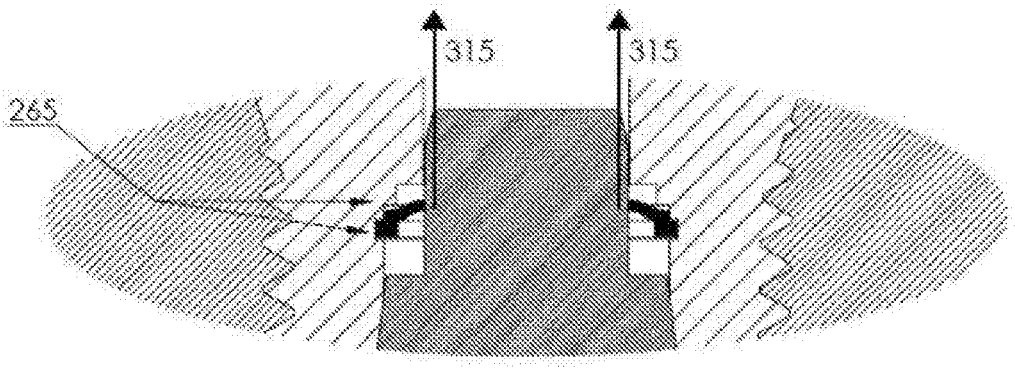

Concerning FIG. 3, unscrewing the plug 255 relative to the cooler walls 305 by application of torque 300 on the head, such as by means of a wrench, results in the plug moving longitudinally up relative to the cooler by a screw action along external threads 310 on the plug. This upward force is propagated to the zinc rod via the retention apparatus 265. A key characteristic of the retention apparatus, as previously described, is that it allows the plug to rotate freely about a stuck zinc rod 240 while still holding it in place along its length. The result is that a purely tensile force 315 is translated to the rod 240, which serves to pull the plug out of the cooler along its strongest direction. No torsional force, which can cause breaking of the rod in the weaker shoulder area, is applied to the rod. This is achieved both by the self-locking ring, shown at reference character 205 in FIG. 2, allowing rotation of the rod relative to itself and the ability of the ring itself to rotate relative to its supporting shelf, shown at reference character 200 in FIG. 2.

Figure 4A:
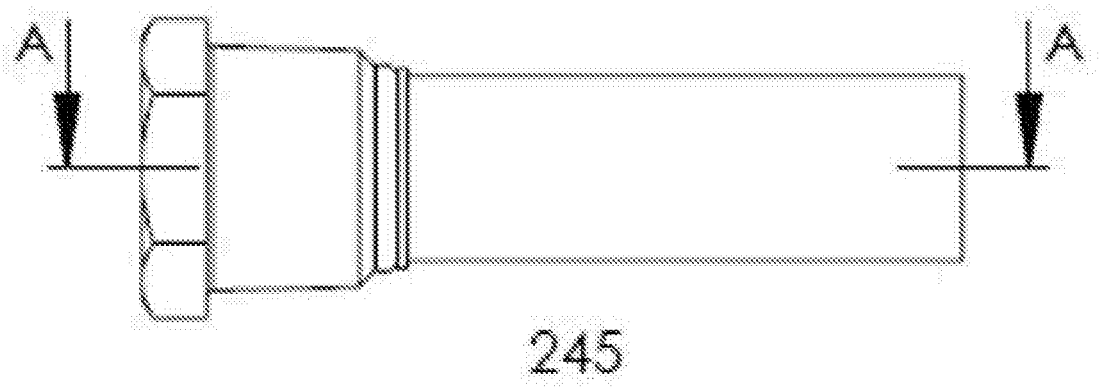
FIGS. 4A-4C illustrate a rod release mechanism associated with a zinc rod-plug assembly of the present invention.
Figure 4B:
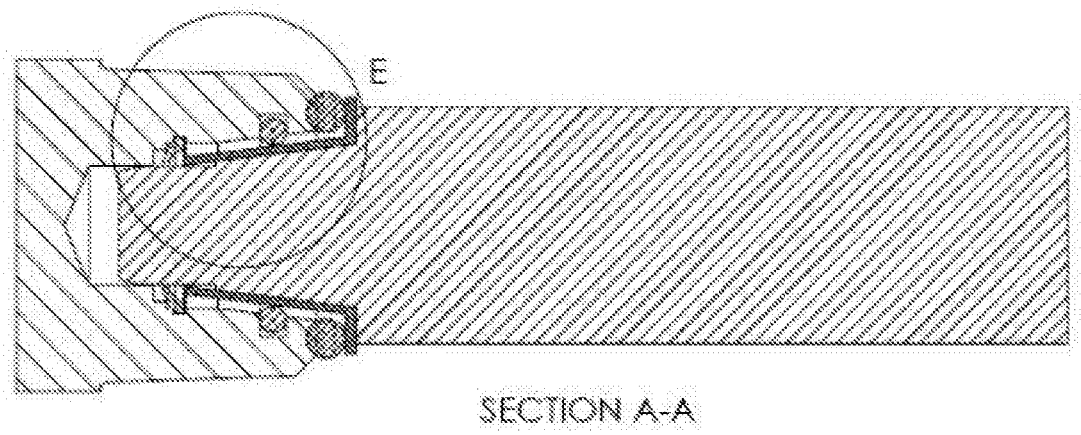
Figure 4C:
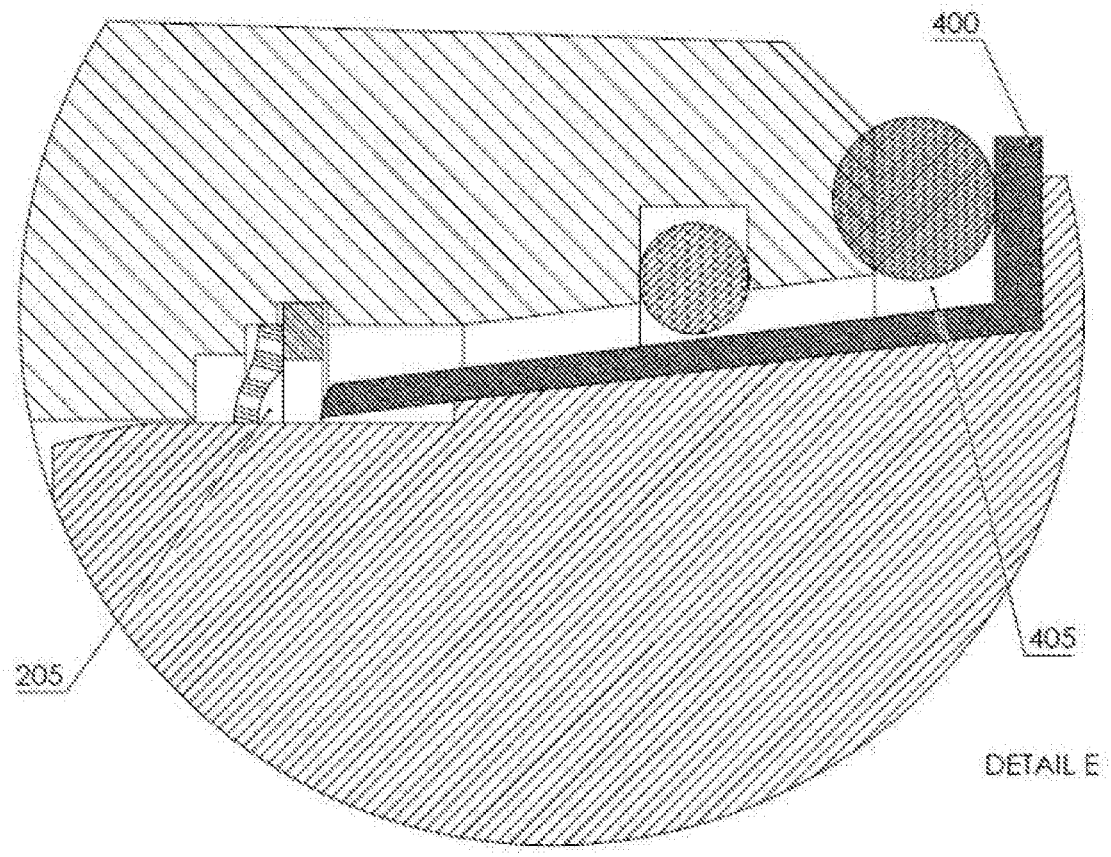

Furthermore, the present embodiment of the invention includes an optional sleeve to release the self-locking ring in order to facilitate removing the remnants of the spent rod from the plug and reusing the plug with a replacement rod. Referring to FIG. 4, the thin sleeve 400 wraps around the taper of the rod and rests on the inner, locking edge of the self-locking ring 205. The upper end of the sleeve terminates in the gap between the plug opening and the shoulder of the rod 405, serving as a substitute for the o-ring, shown at reference character 250 in FIG. 2. Pushing the sleeve down causes the retention mechanism to release the rod. In the case of the present embodiment, the inner, locking edge of the self-locking retaining ring 205 is forced to disengage from the rod effecting its release from the plug cavity.

In the present embodiment, the plug itself is secured to the cooler in the traditional way of using external, self-sealing (NPT) threads. The inventive aspects of the present embodiment concern the internal cavity retention apparatus and retention points. Any housing/outer plug design that employs the anode retention apparatus described herein is also within the scope of the present invention.

Although the aforementioned embodiments of the present invention are described relative to marine engines and coolers, those of ordinary skill in the art will appreciate that marine engine and coolers are an exemplary application and that the present invention applies to other marine or non-marine components that require the use of sacrificial pencil-type anodes and/or the insertion of any rod-like component into a device cavity, including but not limited to the purpose of combating galvanic and electrolytic corrosion, e.g., water makers, desalinization equipment, pipelines, water heaters, pumps, generators, etc.

It should be understood by those skilled in the art that various changes may be made and equivalents substituted without departing the spirit and scope of the invention described herein and by the appended claims. In addition, modifications may be made to adapt to a particular situation, material, composition of matter, method, process, series of steps to achieve the objective of the present invention while staying within the spirit and scope of the invention, and such modifications are intended to be within the spirit and scope of the appended claims. In particular, while the methods disclosed have been described with reference to particular usage cases and particular mechanical embodiments, it will be understood that these usage cases, applications, and particular embodiments may be combined, subdivided, expanded upon, and reordered without departing the teachings of the present invention. Accordingly, the order, grouping of steps, usage cases, and particular embodiments are not a limitation of the present invention. Such variants include, but are not limited to, the number of retention points, the location of retention points, alternate embodiments of retention apparatus including, but not limited to, different types of retention rings, self-locking rings, rings, or retention apparatus machined directly into the plug body or integral to the plug body in any way or alternate mechanisms for retaining the rod within the cavity to ensure reliable extraction of rods from coolers as described herein, shapes of rods, materials of plugs and rods, and insertion into components/items other than anodes, such as sensors including, but not limited to, temperature sensors, pressure sensors, and water sensors.

What is claimed is:

1. A sacrificial anode assembly comprising:

a sacrificial anode rod; and a companion plug having an outer threaded circumference configured to thread into a structure for containing fluid within a system, the companion plug having a plug cavity in which the sacrificial anode rod is received, wherein the sacrificial anode rod is secured within the plug cavity via a retention apparatus configured to:

permit the sacrificial anode rod, upon becoming stuck and unable to rotate within the structure due to internal corrosion, to be pulled out of the structure by a linear pulling force exerted by the companion plug as the companion plug is unthreaded from the structure, the force being applied through the retention apparatus to the sacrificial anode rod, and permit free rotation of the companion plug relative to the stuck sacrificial anode rod as the companion plug is unthreaded to avoid exerting torsional force on the stuck sacrificial anode rod that would otherwise cause the sacrificial anode rod to break.

2. The assembly of claim 1, wherein the plug cavity of the companion plug is straight, tapered, or has a profile corresponding to a profile of a shank of the sacrificial anode rod, and houses either one or more retention points and retention apparatuses to secure the sacrificial anode rod to the companion plug.

3. The assembly of claim 1, wherein a shank of the sacrificial anode rod is straight, tapered, or has a profile corresponding to a profile of a plug cavity of the companion plug.

4. The assembly of claim 1, wherein the retention apparatus comprises non-integral components.

5. The assembly of claim 4, wherein the non-integral components include one or more retaining rings.

6. The assembly of claim 1, wherein the retention apparatus comprises integral components.

7. The assembly of claim 6, wherein the integral components include one or more retaining rings formed as part of a cavity wall of the companion plug.

8. The assembly of claim 1, wherein the retention apparatus comprises non-integral components and integral components.

9. The assembly of claim 8, wherein the non-integral components include one or more retaining rings, and wherein the integral components include one or more retaining rings formed as part of a cavity wall of the companion plug.

10. The assembly of claim 2, wherein the retention apparatus comprises one or more self-locking push rings installed within one or more grooves or upon one or more shelves in the plug cavity of the companion plug.

11. The assembly of claim 10, wherein one or more spiral rings, spring rings, and/or springs are installed within the one or more grooves or upon the one or more shelves in the plug cavity of the companion plug for assisting in implementing the retention apparatus.

12. The assembly of claim 1, wherein one or more internal and/or external o-rings are provided for sealing and protecting the retention apparatus from raw water to prevent corrosion.

13. The assembly of claim 1, wherein one or more internal and/or external o-rings are provided for serving as a cushioning and stabilizing bearing surface that prevents the sacrificial anode rod from chattering against a plug wall of the companion plug and prevents fatigue at contact points in the retention apparatus.

14. The assembly of claim 1, wherein one or more internal and/or external o-rings are provided for serving as a barrier between a shoulder of the sacrificial anode rod and an opening, shoulder-facing surface of the companion plug to prevent fusing together as a result of corrosion.

15. The assembly of claim 1, wherein one or more air gaps are provided for serving as a barrier between a shoulder of the sacrificial anode rod and an opening, shoulder-facing surface of the companion plug to prevent fusing together as a result of corrosion.

16. The assembly of claim 2, wherein a release mechanism is provided to disengage the retention apparatus and permit removal of the sacrificial anode rod from the plug cavity.

17. The assembly of claim 16, wherein the release mechanism includes a tapered sleeve.

18. The assembly of claim 1, wherein the plug cavity has exactly one opening.

* * * * *